US009534413B2

(12) United States Patent
Ma

(10) Patent No.: US 9,534,413 B2
(45) Date of Patent: Jan. 3, 2017

(54) WEIGHT PLATE

(76) Inventor: Oliver Ma, Arcadia, CA (US)

( * ) Notice: Subject to any disclaimer, the term of this patent is extended or adjusted under 35 U.S.C. 154(b) by 101 days.

(21) Appl. No.: 12/704,405

(22) Filed: Feb. 11, 2010

(65) Prior Publication Data

US 2011/0180679 A1 Jul. 28, 2011

Related U.S. Application Data

(60) Provisional application No. 61/298,859, filed on Jan. 27, 2010.

(51) Int. Cl.
*A47G 29/00* (2006.01)
*E04H 12/22* (2006.01)
*G09F 15/00* (2006.01)

(52) U.S. Cl.
CPC ..... *E04H 12/223* (2013.01); *G09F 15/00* (2013.01); *G09F 15/0056* (2013.01)

(58) Field of Classification Search
USPC ..... 248/346.01, 310, 346.06, 673, 523,248/346.03, 501, 910; D11/212
See application file for complete search history.

(56) References Cited

U.S. PATENT DOCUMENTS 1,332,618 A * 3/1920 Durham ..... 248/311.2
2,507,308 A * 5/1950 Kruger ..... 248/343
3,415,475 A * 12/1968 Goodman ..... 248/158
3,622,203 A * 11/1971 Steere, Jr. ..... 297/482
D246,141 S * 10/1977 Mazur ..... D11/212
4,190,221 A * 2/1980 Updike ..... 248/551
4,473,316 A * 9/1984 Welch ..... 403/246
D288,162 S * 2/1987 Hutton et al. ..... D6/607
4,786,119 A * 11/1988 Smuda ..... 312/195
4,932,105 A * 6/1990 Muller ..... 24/666
4,987,656 A * 1/1991 Sato ..... 24/297
5,024,409 A * 6/1991 Bohnen ..... 248/222.41
5,094,422 A * 3/1992 Tiffany ..... 248/519
D339,521 S * 9/1993 Bartlett et al. ..... D8/394
6,047,940 A * 4/2000 Kaplan ..... 248/501
6,109,819 A * 8/2000 Welch ..... 403/353
6,262,382 B1 * 7/2001 Thomas ..... 200/293
6,488,256 B1 * 12/2002 Chang ..... 248/670
6,786,462 B1 * 9/2004 Bland ..... 248/505
6,981,680 B1 * 1/2006 Gordon et al. ..... 248/346.01
7,086,530 B2 * 8/2006 Price et al. ..... 206/477
7,287,474 B2 * 10/2007 Whitley ..... 102/358
7,413,371 B2 * 8/2008 Arnold et al. ..... 403/353
8,074,952 B2 * 12/2011 Baechle ..... 248/346.03
8,118,157 B1 * 2/2012 Piccolin ..... 206/3
2009/0152428 A1 * 6/2009 Cilia ..... 248/346.03
2009/0272872 A1 * 11/2009 Hoffman et al. ..... 248/673

* cited by examiner

*Primary Examiner* — Bradley Duckworth
(74) *Attorney, Agent, or Firm* — Inskeep IP Group, Inc.

(57) ABSTRACT

A weight plate for securing portable structures employing a low-profile, planar plate having an aperture formed therethrough. The aperture is configured so as to allow the base of the leg of a structure to pass through. The plate is subsequently transposed so as to lock the base of the leg underneath the plate while the leg of the shelter passes through the plate and an opposite side of the plate extends away form the leg.

8 Claims, 5 Drawing Sheets

WEIGHT PLATE

RELATED APPLICATIONS

This application claims priority to U.S. Provisional Application Ser. No. 61/298,859 filed Jan. 27, 2010, entitled Weight Plate, the contents of which are incorporated in their entirety herein.

FIELD OF THE INVENTION

The present invention relates to portable shelters and advertising displays and, more particularly, to devises and methods for securing such structures.

BACKGROUND OF THE INVENTION

The evolution of light-weight, easily erected, and economical portable shelters, advertising stands and similar structures has led to the increasing commercial and private use of these structures. However, due to the light-weight construction of such structures, the structures must often be anchored or stabilized so as to prevent movement of the structure caused by physical contact in highly congested areas such as convention centers or by environmental elements such as wind.

Various methods and portable devices have thus far been used to stabilize these structures. For example, systems employing guy-lines have been used in which one end of the guy-line is attached to a shelter awning or a leg of the structure and the other end of the guy-line is anchored to the ground or floor. While these guy-line systems may serve to improve stability, they have the disadvantage of effectively increasing the foot-print of the structure due to the guy-lines extending outward away from the perimeter of the structure. Guy-lines also create a hazard for people walking in the area of the shelter.

Other methods and devices for stabilizing the shelters are directed towards adding weight to the legs of the shelter or to the bases of the legs of the shelter. One approach has been to place an object such as a relatively thick piece of metal over the base and around a portion of the leg of the structure. Such weights have the disadvantage of being relatively high-profile, effectively decreasing the available space around the leg of the structures, and being awkward or inconvenient to transport due to their relatively heavy compact form. Another approach has been to employ relatively large, usually plastic containers or vessels that, again, rest on top of the base and around the leg of the shelter. Such plastic containers are intended to be deployed about the leg of the structure and then filled with a substance that can later be removed from the container, such as sand or water. An obvious disadvantage of these systems is that the user must not only transport the plastic containers but must also transport or otherwise locate, and then later dispose of, the sand or water used to fill the container. Like the weight systems described above, these systems also effectively decrease the available space around the legs of the structures.

The fact that the known solutions for stabilizing portable structures effectively decrease the usable area around the legs of the structure is not trivial. For example, creating unusable areas around the leg of a portable shelter used at a trade convention or other venue in which displays and structures must abut one another not only decreases the usable space under the structure but may also prevents structures from being erected immediately next to one another.

What is needed in the art is a low-profile, easily transportable device and method for stabilizing the legs of portable shelters, advertizing stands, and similar structures.

OBJECTS AND SUMMARY OF THE INVENTION

The present invention provides a weight plate having a mass sufficient to stabilize the leg of a portable shelter or advertizing stand and a profile that is sufficiently low so as avoid occupy space within or outside of the structure. The weight plate of the present invention employs a low-profile, planar plate having an aperture formed therethrough. The aperture is configured so as to allow the base of the leg of a structure to pass through. The plate is subsequently transposed so as to lock the base of the leg underneath the plate while the leg of the shelter passes through the plate and an opposite side of the plate extends away form the leg.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
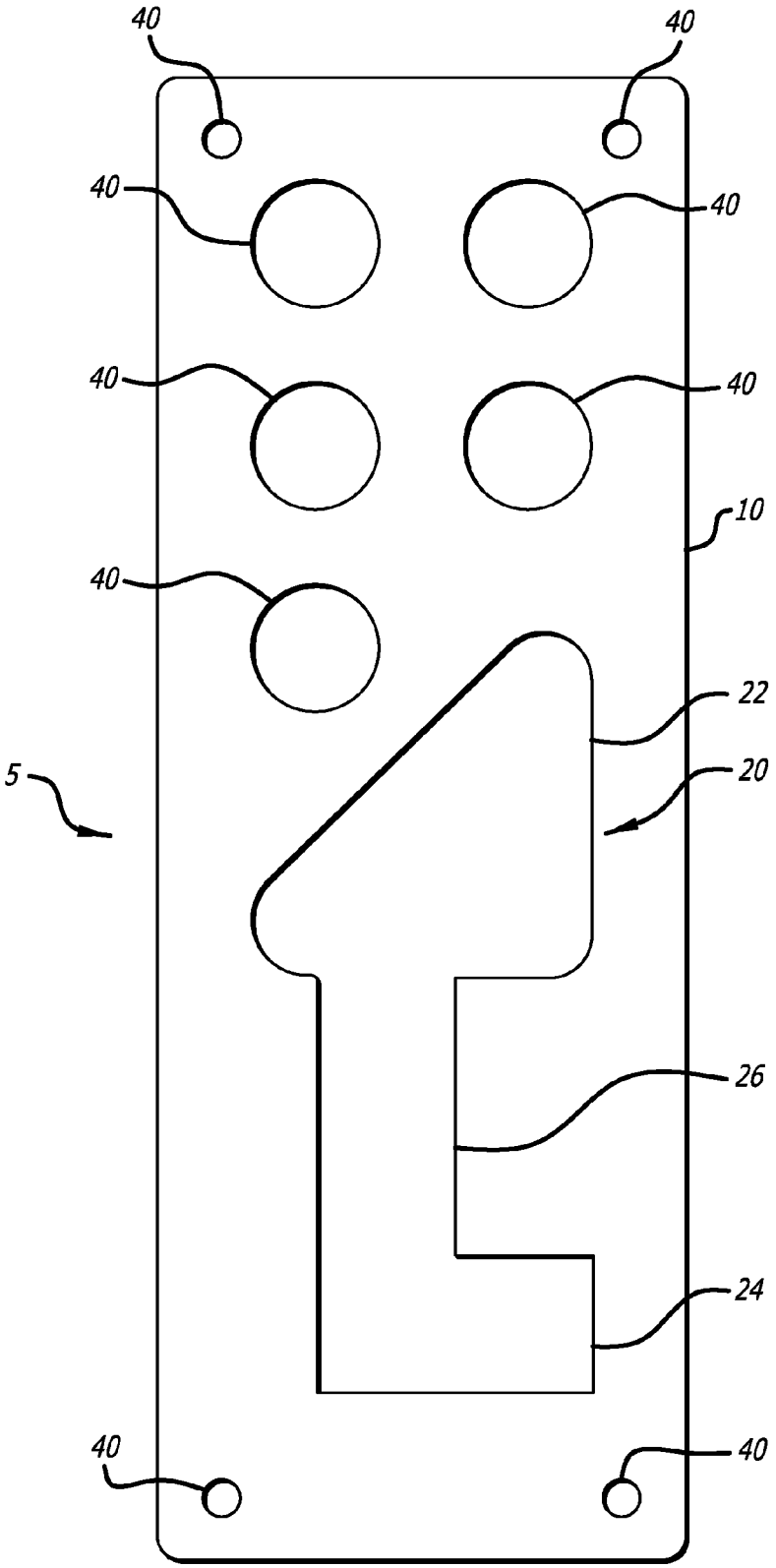
FIG. 1 is a plan view of a weight plate according to certain embodiments of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
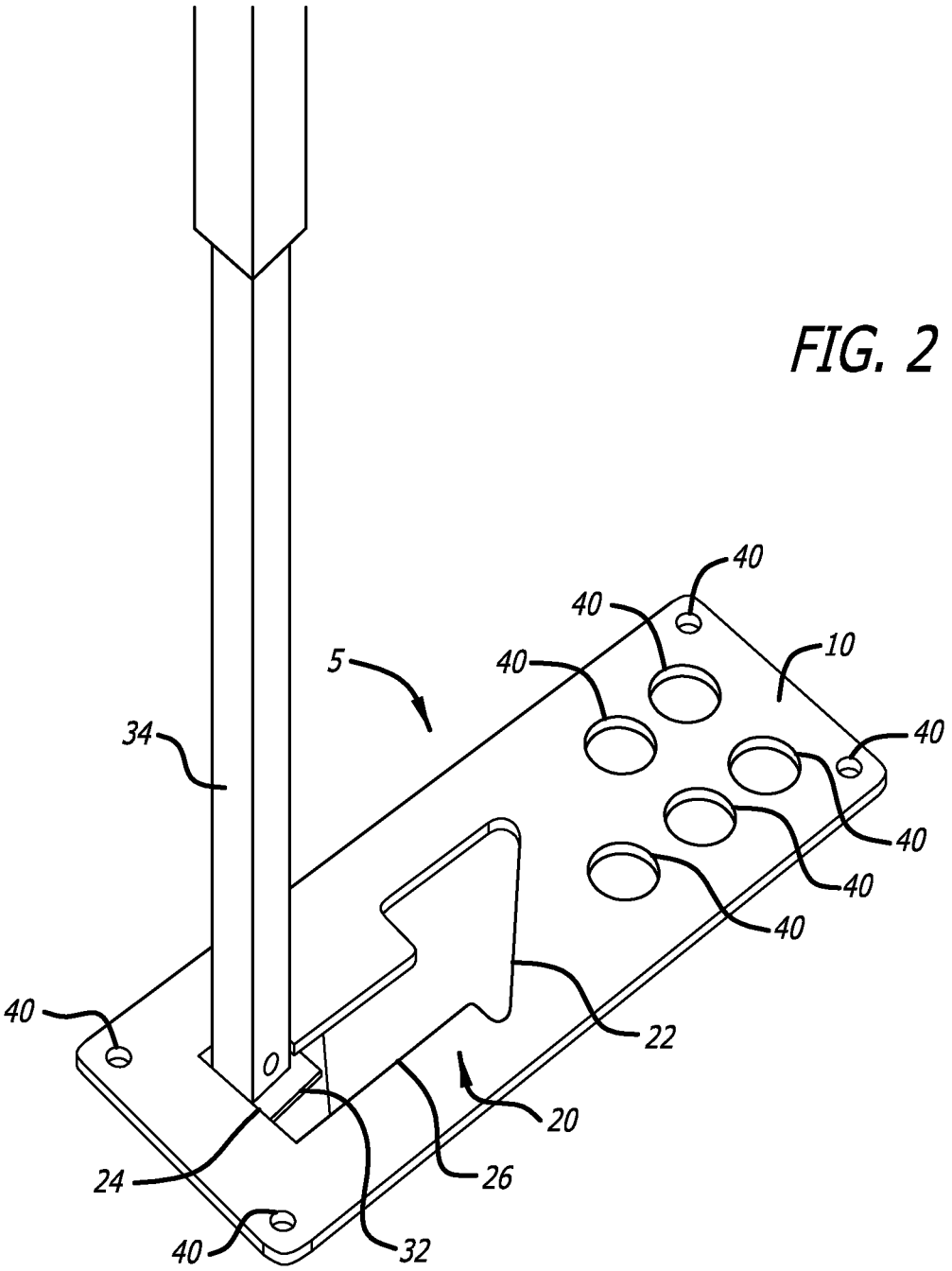
FIG. 2 is a perspective view of a weight plate in operation according to certain embodiments of the present invention.

As shown in FIGS. 1 and 2, according to one embodiment of the present invention, a weight plate 5 comprises a plate 10 formed in an elongated shape such as a rectangle. For example, a length of the plate 10 is approximately 355.6 mm and a width of the plate 10 is approximately 127 mm and a thickness of the plate 10 is approximately 2.2 mm to 2.5 mm. The plate 10 has a plate-like form that is approximately planar. The plate is formed of a material such as a metal, alloy, polymer, or a combination thereof. For example, the plate 10 may be formed of an alloy and coated with a different material so as to provide a texture or a protective and/or non-corrosive coating.

A first or primary aperture 20 is formed through the plate 10. The aperture 20 has an irregular shape comprising a proximal portion 22 connected to a distal portion 24 through a central portion 26. The proximal portion is positioned at or near a mid-point of the plate 10 and has a triangular shape. For example, the proximal portion 22 may be a right triangle having catheti of approximately 82 mm in length. As shown in FIG. 2, the proximal portion 22 of aperture 20 is sized so as to receive or pass a base 32 of a leg 34 of a portable shelter (not shown in its entirety) therethrough. For example, the base 32 of the leg 34 of the portable shelter may have a triangular form that is similar to the triangular shape of the proximal portion 22 but smaller than the triangular proximal portion 22 of the aperture 20. It will be under stood that alternative shapes of the proximal portion 22 of the aperture 20 are contemplated so as to correspond with the assorted shapes of the bases 32 of the legs 34 of portable shelters.

The distal portion 24 is positioned or offset towards one side of the plate 10 and has an approximately rectangular shape. The central portion 26 also forms a rectangular shape and connects one side of the proximal portion 22 to one side of the distal portion 24 of the aperture 20. The central portion 26 and the distal portion 24 of the aperture 20 are sized so as to be slightly larger than the leg 34 of the portable shelter and smaller than the base 32 of the leg 34 of the portable shelter. Stated alternatively, the central portion 26 and the distal portion 24 of the aperture 20 are sized such that the leg 34 of the shelter may move freely therethrough but that the base 32 of the leg 34 of the shelter may not pass or move therethrough. For example, the central portion 26 of the aperture 20 may have a width of 33 mm. The central portion 26 of the aperture 20 connects to the distal portion 24 so as to form a shape similar to that of an L, thereby providing a notch into which the leg 34 of the shelter can be positioned and secured so as to discourage movement of the leg 34 back towards the proximal portion 22.

Figure 3:
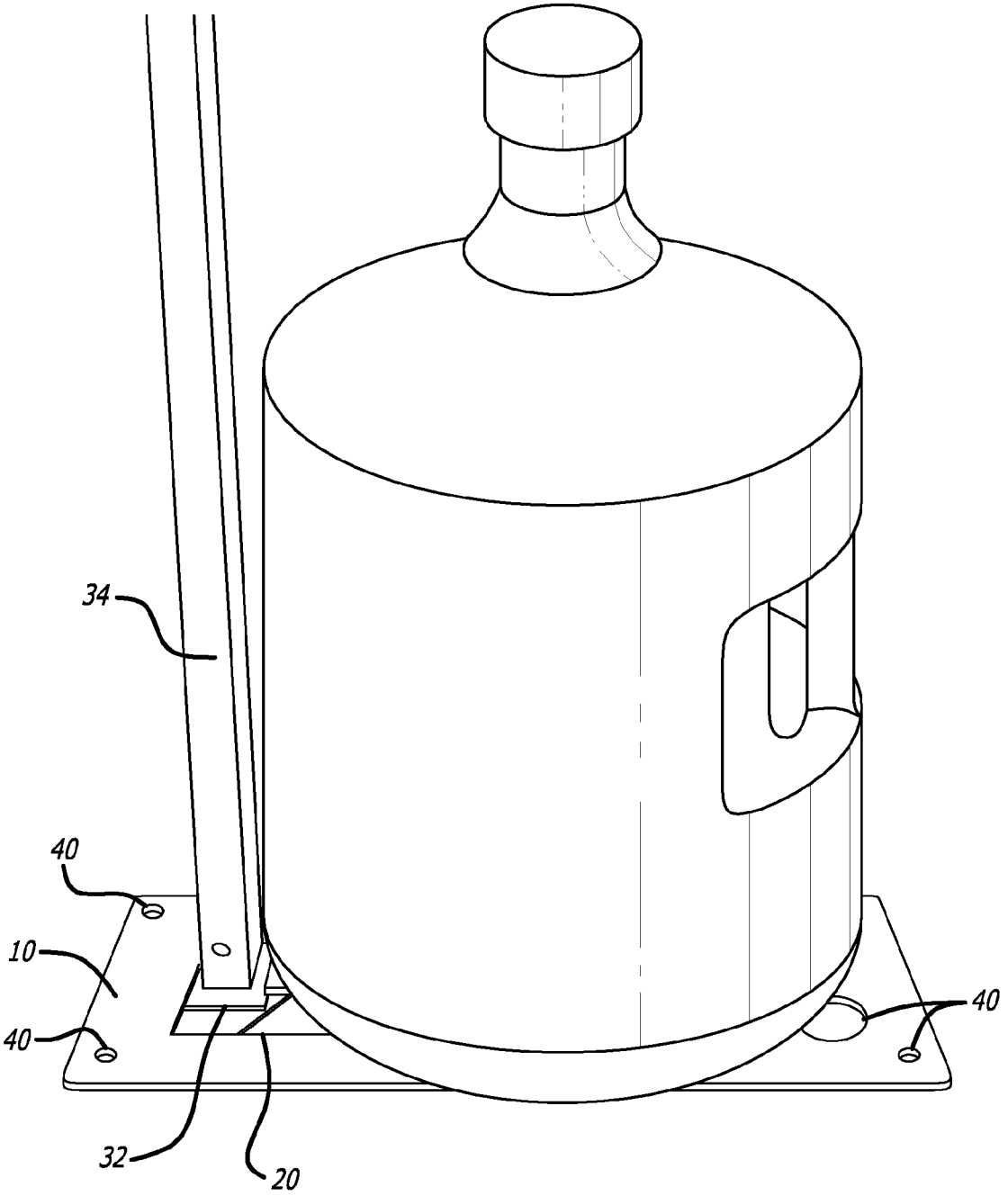
FIG. 3 is a perspective view of a weight plate in operation according to certain embodiments of the present invention.
Figure 4:
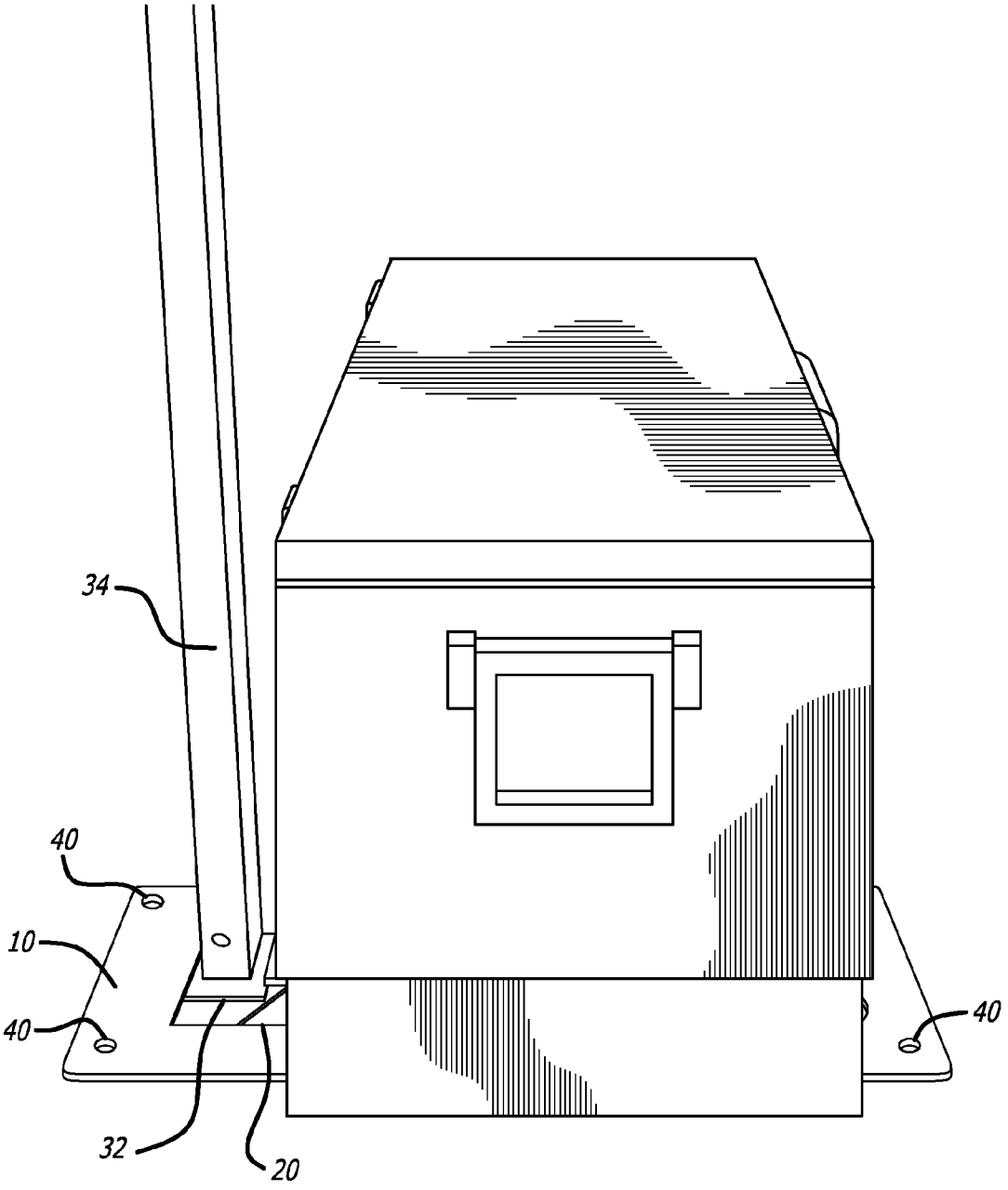
FIG. 4 is a perspective view of a weight plate in operation according to certain embodiments of the present invention.
Figure 5:
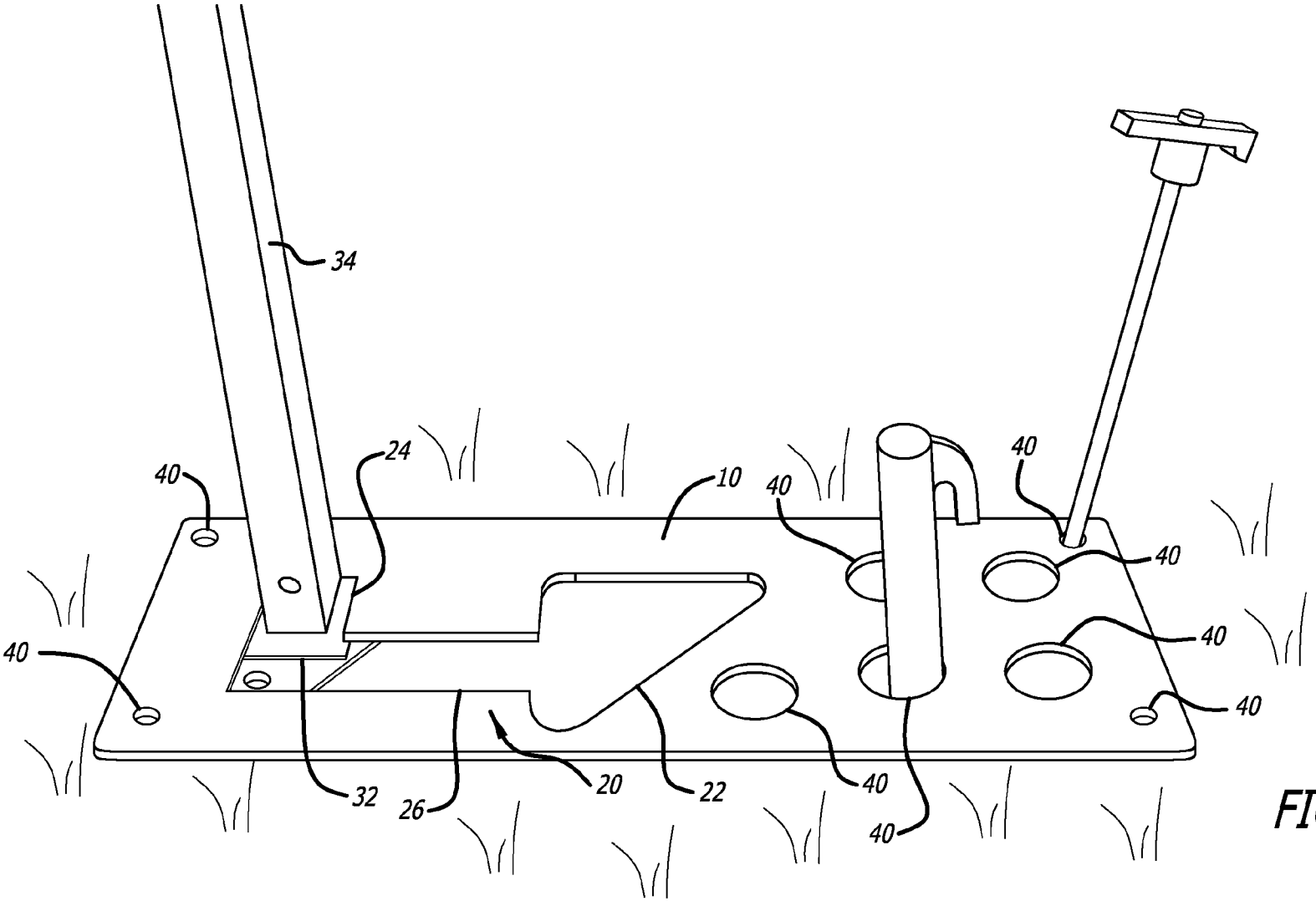
FIG. 5 is a perspective view of a weight plate in operation according to certain embodiments of the present invention.

As shown in FIGS. 1-5, the plate 10 may employ one or more secondary apertures 40 in addition to the primary aperture 20. The secondary aperture 40 may be formed in varying sizes and shapes. For example, the plate 10 may employ secondary apertures 40 at each of the four corners of the plate 10 that are smaller than the secondary apertures 40 employed else where within the plate 10. As shown in FIG. 5, the secondary apertures 40 may serve to receive or otherwise facilitate engagement with stakes so as to further stabilize the plate 10 and the leg 34 of the shelter. For example, a stake can be passed through the secondary aperture 40 such that a head portion of the stake engages the plate 10 and a shaft portion of the stake engages the ground. The secondary apertures 40 may also serve to reduce the weight of the plate 10 and/or provide a handle so as to facilitate transportation of the weight plate 5.

With reference to FIG. 2, in use, a portable shelter or similar structure is first erected. Once erected, the base 32 of one of the legs 34 of the portable shelter is passed through the proximal portion 22 of the aperture 20. The plate 10 is then maneuvered such that the leg 34 of the shelter passes through the central portion 26 and into the distal portion 24 of the aperture 20. In this manner the base or foot 32 of the leg 34 of the portable shelter is confined beneath the plate 10 and the leg 34 of the shelter passes through the distal portion 24 of the aperture 20. Since the distal portion 24 of the aperture 20 is positioned so as to be offset to one side of the plate 10, the remaining portion or opposite side of the plate 10 is cantilevered away from the leg of the shelter.

As shown in FIGS. 3 and 4, the above-described configuration of the present invention also facilitates further stabilization of the plate 10 and the leg 34 of the shelter by providing a planar surface extending away from the leg 34 upon which objects such as water jugs and coolers can be place to add additional weight and stability to the system.

The low-profile, planar form of the weight plate 5 provides the additional benefit of being efficiently stacked so as to facilitate transporting and displaying the weight plate for consumer sales.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A device for stabilizing a base of a leg of a portable structure consisting of:

a weight having a plate-like form and a closed primary aperture located within a single plane, the primary aperture comprising a proximal portion positioned at an approximate center of the weight equidistance from each side of the weight, an elongated central portion of the primary aperture extending from the proximal portion of the primary aperture in a first direction and a distal portion of the primary aperture extending from the central portion of the primary aperture in a second direction distinct from the first direction; and at least one secondary closed aperture.

2. The device of claim 1 wherein the plate-like form of the weight is elongated.

3. The device of claim 1 wherein the proximal portion of the primary aperture has a triangular shape.

4. The device of claim 1 wherein the proximal portion of the primary aperture has a shape that is different from a shape of the distal portion of the primary aperture.

5. A device for stabilizing a base of a leg of a portable structure consisting of:

a weight having an elongated rectangular plate-like form and a closed aperture;

a proximal portion of the aperture is positioned at an approximate center of the weight that is equidistance from each side of the weight and a central portion of the aperture extends from the proximal portion in a first direction and connects the proximal portion of the aperture to a distal portion of the aperture that extends from the central portion in a second direction different from said first direction and that is offset from the center of the weight to a longitudinal end of the weight; and at least one secondary closed aperture.

6. The device of claim 5 wherein the proximal portion of the aperture has a shape that is different from a shape of the distal portion of the aperture.

7. The device of claim 5 wherein a portion of the distal portion of the aperture is offset to a side of the weight relative to the central portion of the aperture.

8. The device of claim 5 wherein a width of the proximal portion of the aperture is greater than a width of the central portion of the aperture.

* * * * *